US006497411B1

(12) United States Patent
Nelson

(10) Patent No.: US 6,497,411 B1
(45) Date of Patent: Dec. 24, 2002

(54) STEER HEAD ROPING TRAINING APPARATUS

(76) Inventor: Leland Nelson, 401 W. Maple St., Mapleton, UT (US) 84664

( * ) Notice: Subject to any disclaimer, the term of this patent is extended or adjusted under 35 U.S.C. 154(b) by 0 days.

(21) Appl. No.: 09/517,820

(22) Filed: Mar. 2, 2000

(51) Int. Cl.[7] ..... A63B 67/06; A63B 63/00; A63B 67/00; A63B 69/00; G09B 19/00

(52) U.S. Cl. ..... 273/338; 273/339; 273/359; 273/336; 434/247; 434/258

(58) Field of Search ..... 273/336–339, 273/348, 359, 368–370, 407; 434/247, 258; 446/269, 279, 280; 119/839

(56) References Cited

U.S. PATENT DOCUMENTS

| | | | |
|---|---|---|---|
| 3,947,033 | A | 3/1976 | Bennett |
| 4,136,874 | A | 1/1979 | McCord |
| 4,266,779 | A | 5/1981 | English |
| 4,268,037 | A | 5/1981 | McKinley et al. |
| 4,286,788 | A | 9/1981 | Simington et al. |
| 4,364,570 | A | 12/1982 | Hallam |
| 4,498,676 | A | 2/1985 | Runner |
| 4,640,515 | A | 2/1987 | Rhine |
| 4,874,179 | A | 10/1989 | Henderson |
| 4,960,076 | A | 10/1990 | Snorgrass et al. |
| 4,981,302 | A | 1/1991 | Narramore |
| 5,009,432 | A | 4/1991 | Richard |
| 5,080,373 | A | 1/1992 | Jones |
| 5,568,926 | A | 10/1996 | Kaptein |
| 5,709,386 | A | 1/1998 | Nelson |

OTHER PUBLICATIONS

James A. MacIntyre; Oct. 15, 1996; Practice Roping Head; The entire document.*

* cited by examiner

*Primary Examiner*—Paul T. Sewell
*Assistant Examiner*—Mitra Aryanpour
(74) *Attorney, Agent, or Firm*—J. David Nelson

(57) ABSTRACT

Apparatus for steer head roping training comprising a simulated steer head with pivoting horns which pivot upwards, and also optionally rearward, as a lasso rope around the horns is pulled by a roping trainee, thereby releasing the lasso for repetitive training. A tension spring, which is attached to the bottom or inside end of each horn and stretched between them, urges the horns to an anatomically correct down position until a lasso rope around the horns is pulled, and restores the horns to an anatomically correct position when the lasso has been released. A head pivoting bracket may also provide for upward pivoting of the head as the lasso rope is pulled, further facilitating the release of the lasso from the horns, and for restoring the head to an anatomically correct down position when the lasso has been released.

12 Claims, 7 Drawing Sheets

STEER HEAD ROPING TRAINING APPARATUS

FIELD OF THE INVENTION

This invention relates to devices for roping skills training, and particularly, to training devices for steer head roping skills.

BACKGROUND OF THE INVENTION

Steer head roping is perhaps one of the oldest roping skills practiced by those engaged in cattle ranching operations. It remains a vital skill for those involved in handling cattle on the open range and in other settings, even in the most modem of ranching operations.

Interest in developing roping skills and in roping competition has also steadily increased, particularly with the advent of rodeo and jackpot team roping, which has become one of the more popular forms of equestrian competition. Currently, over a hundred thousand team ropers compete each year for millions of dollars in prize money. These competitions are held throughout the west, mid-west and southern states.

Team roping involves one team member, the header, roping the head and the other team member, the heeler, roping the hind legs of the steer. Because of the highly competitive nature of this event, a high level of proficiency involving split second timing is required for the team member which ropes the head. The high level of proficiency required can only be developed through a considerable amount of repetitive practice.

Because there is only a limited number of practice animals and limited facilities for practicing, the repetitive practice of roping skills on live animals is not practical. It is also not humane because of the cumulative stress and distress imposed on the animals. Furthermore, obtaining and maintaining a collection of livestock and a large arena with the required facilities is very costly. Also, it is very difficult to make efficient use of one's time in practicing with live animals. Accordingly, there has long been a need for alternative means for practice and training.

Training devices of various kinds have been developed through the years to assist in the training of headers. Since most headers prefer to rope just the horns of the steer, the simplest training device is a set of horns which can be affixed to a bail of hay or any other anchoring object. The simple devices also include a dummy steer head, with dimensions approximating a typical steer head and with horns of a fixed length. These simple devices can also be mounted on a mobile object such as an ATV or a simulated steer pulled behind a motor vehicle to provide for some in-motion training from horseback. These devices require the roper to manually remove the rope from the horns or head of the dummy before proceeding with another practice throw.

Several prior art devices have been developed to deal with these problems and limitations of typical steer head roping dummies. U.S. Pat. No. 3,066,939 to Sprout discloses an apparatus with hinged horns which immediately releases the rope with little resistance. The roper will often have difficulty determining if he has correctly roped both horns. U.S. Pat. No. 4,364,570 to Hallam discloses an apparatus incorporating retractable horns which are remotely actuated and retracted into a hollow steer head, thereby releasing the rope. The horns are then extended back to the roping position for further practice.

Known devices each provide an alternative means for practicing steer head roping without the use of live animals. However, each of these devices fails to meet one or more of the obvious objectives for such a training apparatus.

One of the objectives of the present invention is to provide a steer head roping training apparatus which provides for an automatic, quick but confirmable release of the rope so that the roping practice can be immediately repeated without re-setup or other delay.

It is a further objective of the present invention to provide a steer head roping training apparatus which simulates a typical steer head.

A still further objective of the present invention is to provide a steer head roping training apparatus which allows the ready exchange of horns of various lengths.

A still further objective of the present invention is to provide a steer head roping intraining apparatus which can be readily affixed to an ATV frame or simulated steer for in-motion training.

A still further objective of the present invention is to provide a steer head roping training apparatus which can be readily affixed to popular heeling training apparatuses so that team roping skills of heading and heeling can be practiced simultaneously and in concert by team members.

A still further objective of the present invention is to provide a steer head roping training apparatus which is economical, light and durable. A still further objective of the present invention is to provide a steer head roping training apparatus with inexpensive and easily replaceable parts.

SUMMARY OF INVENTION

The present invention comprises a simulated steer head with horns of a selected length which are pivotally attached to the simulated steer head in transverse pivot grooves. Downward pivoting of each of the horns is limited to an anatomically correct position and the upward pivoting of the horns is in a plane which is roughly perpendicular to the normal direction of forward movement of the simulated animal or may be angled rearward from the vertical so that the tips of the horn rotate somewhat rearward as they are pivoted upward. This pivot angle is determined by the angle of inclination of the pivot groove and the corresponding pivot bolt axis. A tension spring extends between spring anchors on the bottom or the inside end of each of the horns, thereby maintaining the horns in the downward anatomically correct position until they are urged upward during roping practice.

As the user lassos the horns and pulls on the rope, thereby tightening the rope around the horns, the horns pivot with the tips rotating upward, thereby releasing the rope for the next roping practice attempt. Some embodiments also provide for somewhat rearward rotation of the tips of the horns as they rotate upward, thereby facilitating the release of the rope. A tension spring provides desired resistance to the release, thereby providing the user an opportunity to determine that both horns have been appropriately roped. Upon the release of the rope, the horns snap back to the anatomically correct position, ready for another roping attempt.

The apparatus of the present invention may also be equipped with a pivot mount, such as a hay bracket, at the rear end of the simulated steer head by which the head can be pivotally mounted to a support. This pivot mount limits the downward rotation of the head to an anatomically correct forward down position, but allows upward rotation as the rope is tightened and pulled on the horns by the user, thereby facilitating the release of the rope by the apparatus.

DETAILED DESCRIPTION OF PREFERRED EMBODIMENTS

Figure 1:
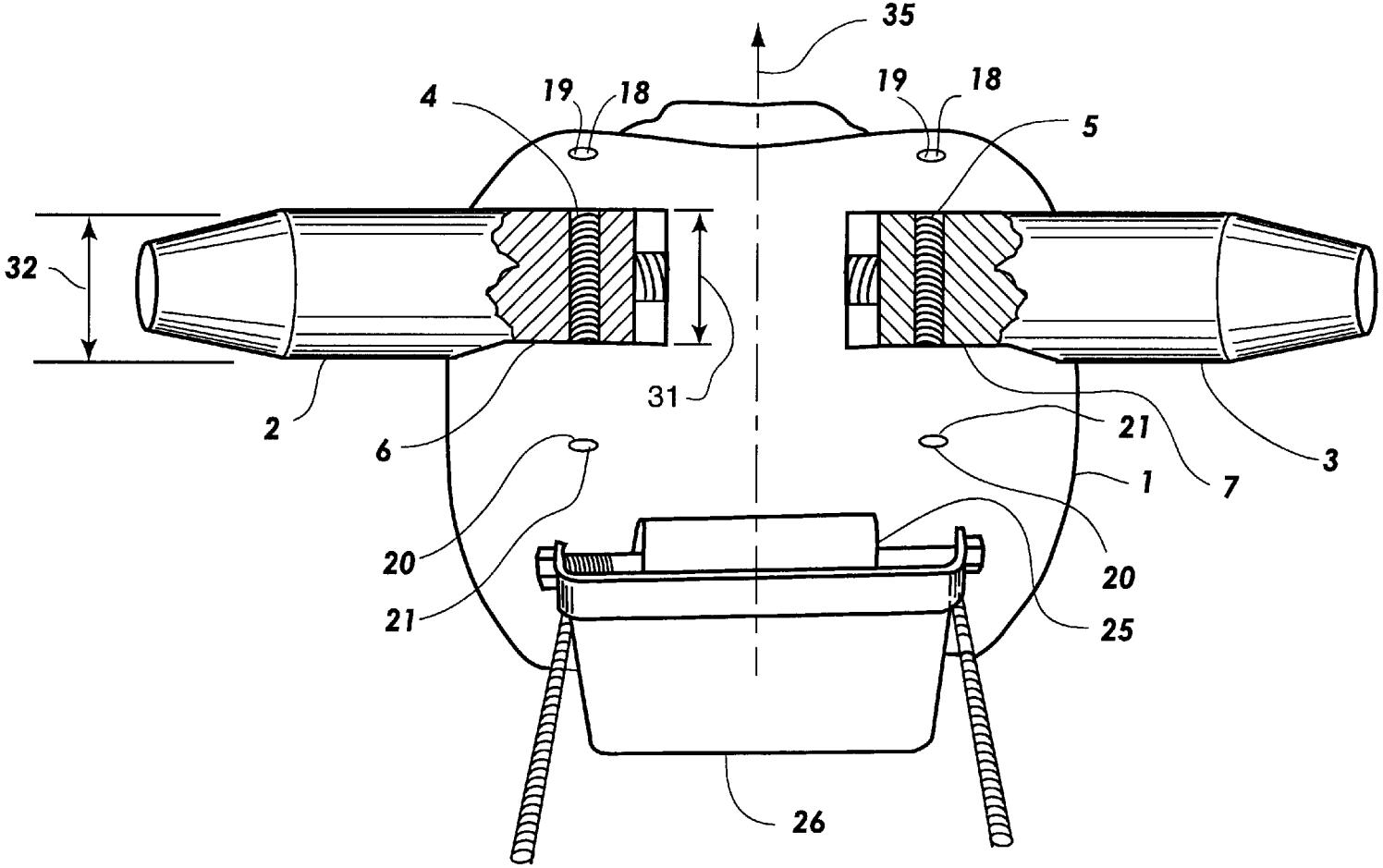
FIG. 1 is a top view of a preferred embodiment of the apparatus of the present invention.
Figure 2:
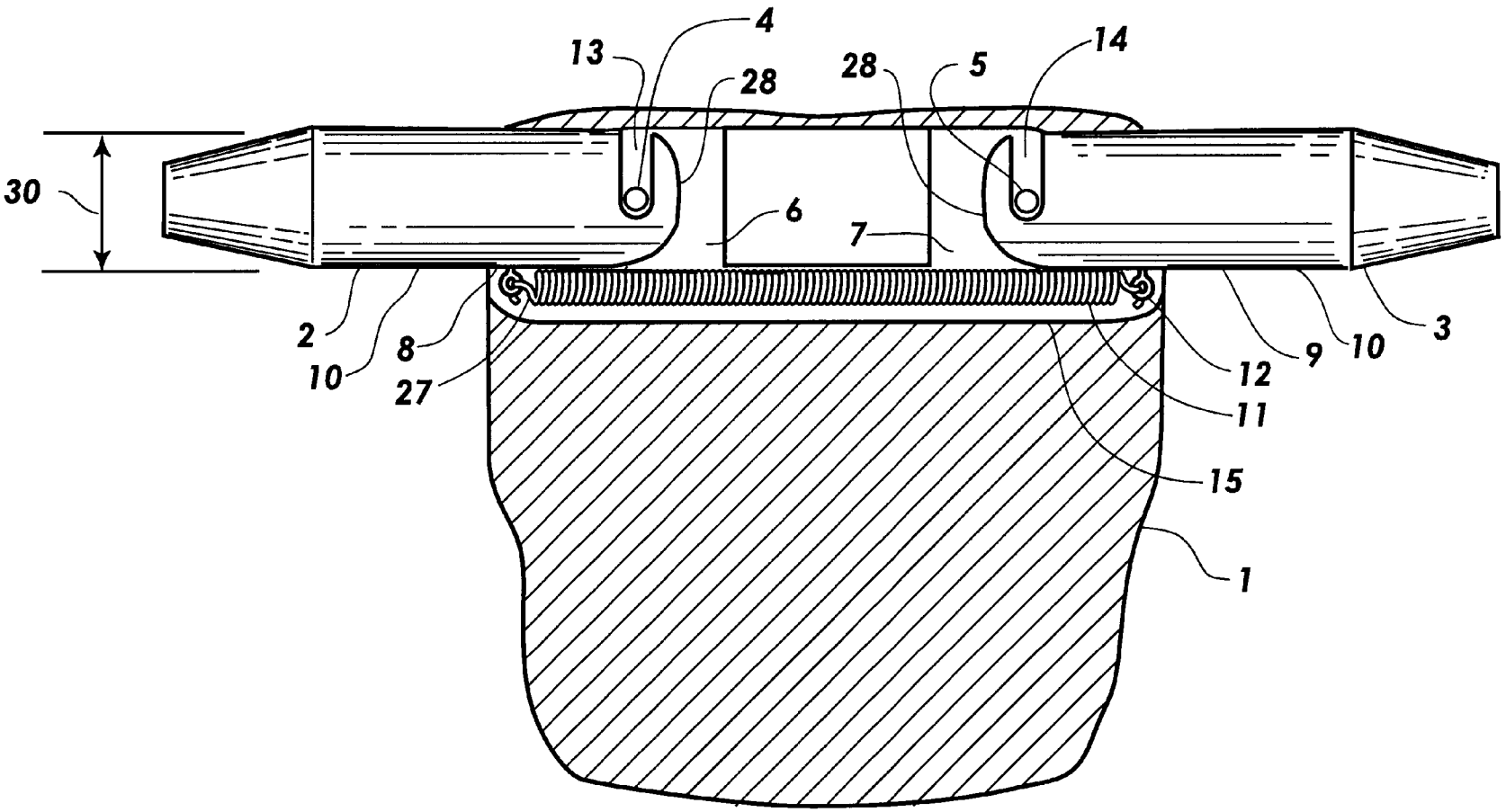
FIG. 2 is a rear view cross section of a preferred embodiment with horns in the down position.
Figure 3:
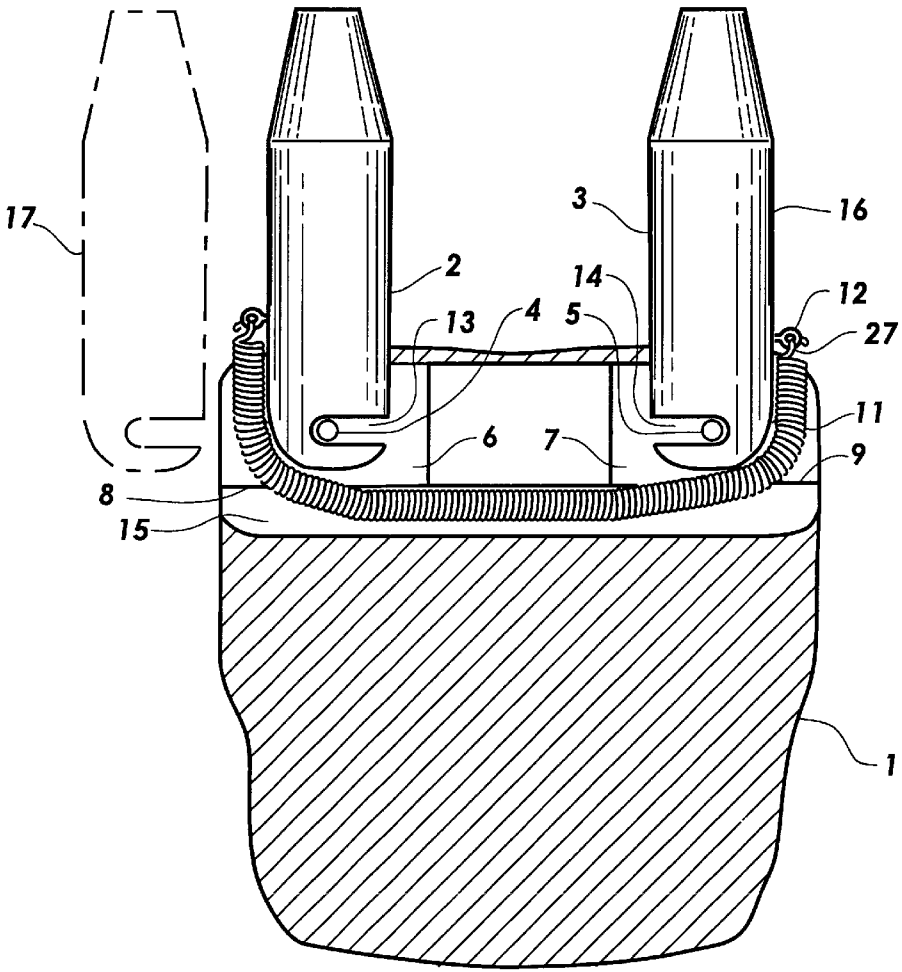
FIG. 3 is a rear view cross section of a preferred embodiment with horns in the release position.

Referring first to FIG. 1, a preferred embodiment of the present invention comprises a simulated steer head 1, a left horn 2, a right horn 3, a left horn pivot bolt 4 pivotally securing the left horn to the simulated steer head in a left horn pivot groove 6, and a right horn pivot bolt 5 pivotally securing the right horn to the simulated steer head in a right horn pivot groove 7. A front pivot bolt fastener 18 which is recessed in a front pivot bolt socket 19 and a rear pivot bolt fastener 20 which is recessed in a rear pivot bolt socket 21 secures each pivot bolt in place in a pivot bolt shaftway 22. The pivot grooves are transverse or perpendicular to the steer head axis 35. Referring to FIG. 2, the left horn pivot groove bottom 8 and the right horn pivot groove bottom 9 limit the downward pivoting of the horns to an anatomically correct down position 10. A tension spring 11 is attached to a spring anchor 12 on each of the horns thereby connecting the horns together and urging the horns to the anatomically correct down position. A left horn bolt groove 13 in the top of the inside end 28 of the left horn and a right horn bolt groove 14 in the top of the inside end 28 of the right horn provide for the free pivoting of the respective horns from the down position 10 to the horn release position 16 as shown in FIG. 3. A horn may also be rotated by hand to the release position for detachment of the tension spring from its spring anchor and for the detachment of the horn from the head by sliding the horn off the pivot bolt to a detachment position 17.

Figure 4:
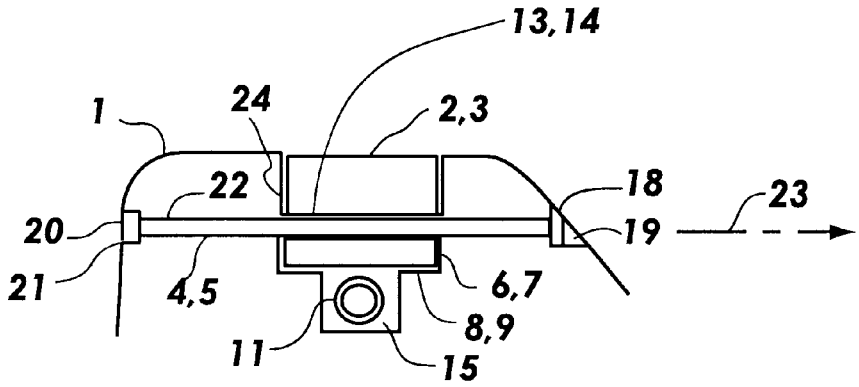
FIG. 4 is a side view cross section detail of a preferred embodiment.

Referring to FIG. 4, the pivot bolt axis 23 for each of the pivot bolts, for some preferred embodiments, will be perpendicular to the walls 24 of the pivot groove, which are perpendicular to the pivot groove bottom. For these embodiments, the pivoting of the horns from the down position to the release position will be generally in a vertical plane. For these embodiments, the release of the rope from the horns may be facilitated by the use of a pivoting bracket such as the common hay bracket 26 shown in FIG. 1, which can be used to attach the apparatus of the present invention to a bale of hay or other stationary support for stationary roping practice. The apparatus of the present invention may be attached to any selected stationary or mobile support and any pivoting or fixed support by use of a bolt inserted through the bracket bolt shaft way 25.

Figure 5:
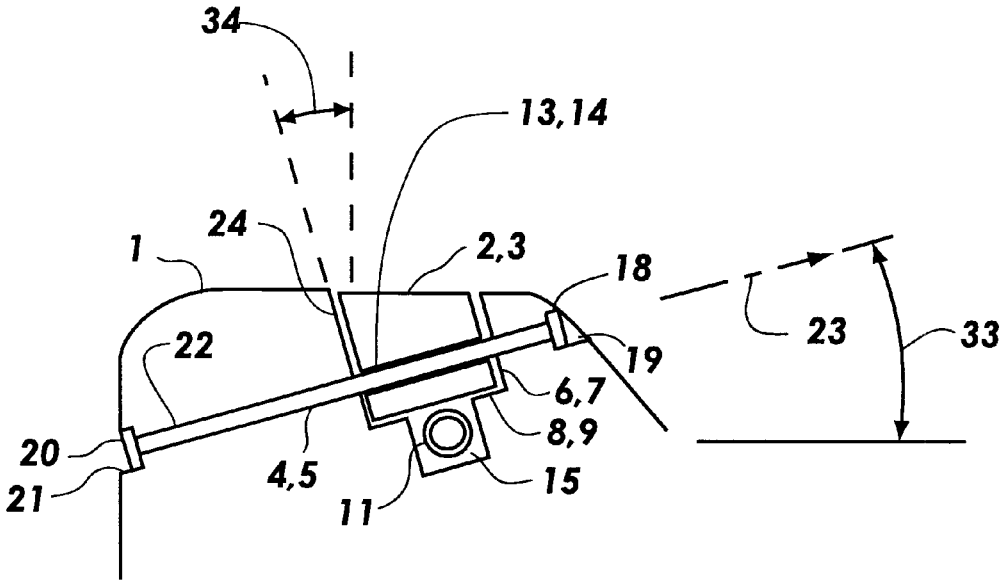
FIG. 5 is a side view cross section detail of an alternative preferred embodiment of the present invention with rearward pivoting horns.

For the alternate preferred embodiment shown in FIG. 5, the pivot bolt axis 23 for both pivot bolts is angled rearward 33 from the horizontal and the pivot groove walls 24, which are perpendicular to the pivot bolt axis, are angled rearward 34 from the vertical. The bottoms of the pivot grooves 8,9 may also be angled rearward as shown in FIG. 5 or may remain generally horizontal as shown in FIG. 4. This embodiment provides for easier release of the rope for repetitive practice, with or without a support attached to the apparatus which provides for upward and rearward rotation of the simulated steer head, such as the hay bracket shown in FIG. 1. Because of the rearward angle of the pivot bolts and the pivot grooves, the tips of the horns also sweep somewhat rearward as the horns pivot upward to the release position.

Figure 6:
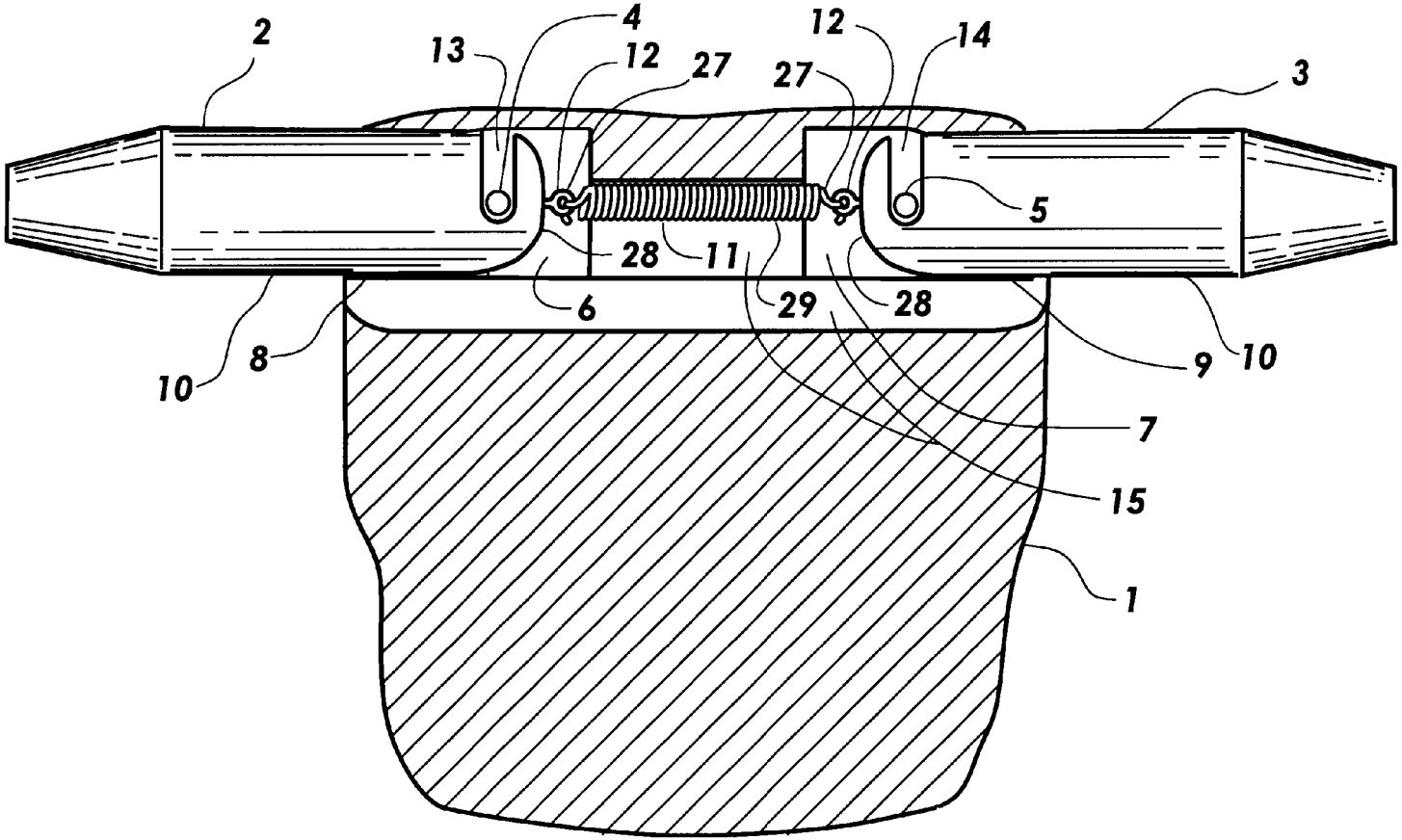
FIG. 6 is a detail of an alternative tension spring arrangement.

Referring to FIGS. 2, 3, 4 and 5, for preferred embodiments a spring groove 15 in the bottom of the pivot grooves provides for the free movement of the tension spring. The spring groove provides for the unimpeded flexion and contraction of the spring as the horns are rotated from the down position 10 as shown in FIG. 2 to the release position 16 as shown in FIG. 3. The spring anchors 12, which may be eye screws, hooks, knobs or similar fasteners, affix the ends 27 of the spring to the horns. The location of the spring anchors on the bottom of the horns can be varied to facilitate the use of springs of varying length and strength. The spring anchors can also be affixed to the inside ends 28 of the horns as shown in FIG. 6. This embodiment offers the advantage of minimizing contact between the spring and the horns. It requires that the spring groove extend up between the horns to the down spring position 29. This embodiment also requires that the spring end is detached from the spring anchor while a horn is in the down position and then the horn is manually rotated to the release position, in order to remove and replace the horn.

Referring to FIG. 2, for preferred embodiments, the pivot bolts are located near the inside end 28 of the horns, thereby minimizing the groove depth 30 of the pivot grooves and providing for free upward rotation of the horns. The pivot groove width 31 is slightly greater than the inside horn end width 32 to provide for a free but smooth pivoting of the horns.

Figure 7:
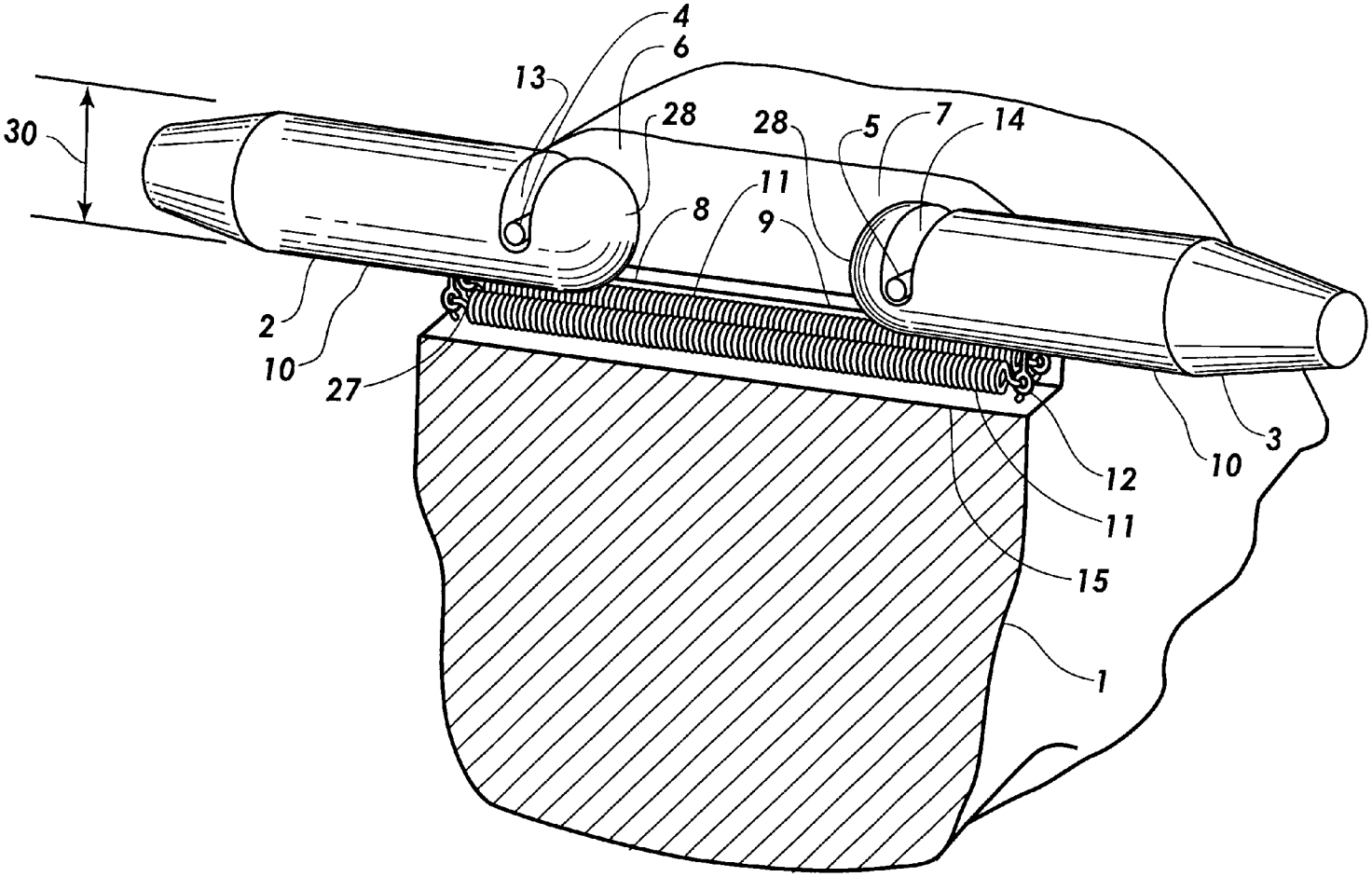
FIG. 7 is a front view perspective cross section of an embodiment of the present invention with two tension springs attached to the bottom of each horn.
Figure 8:
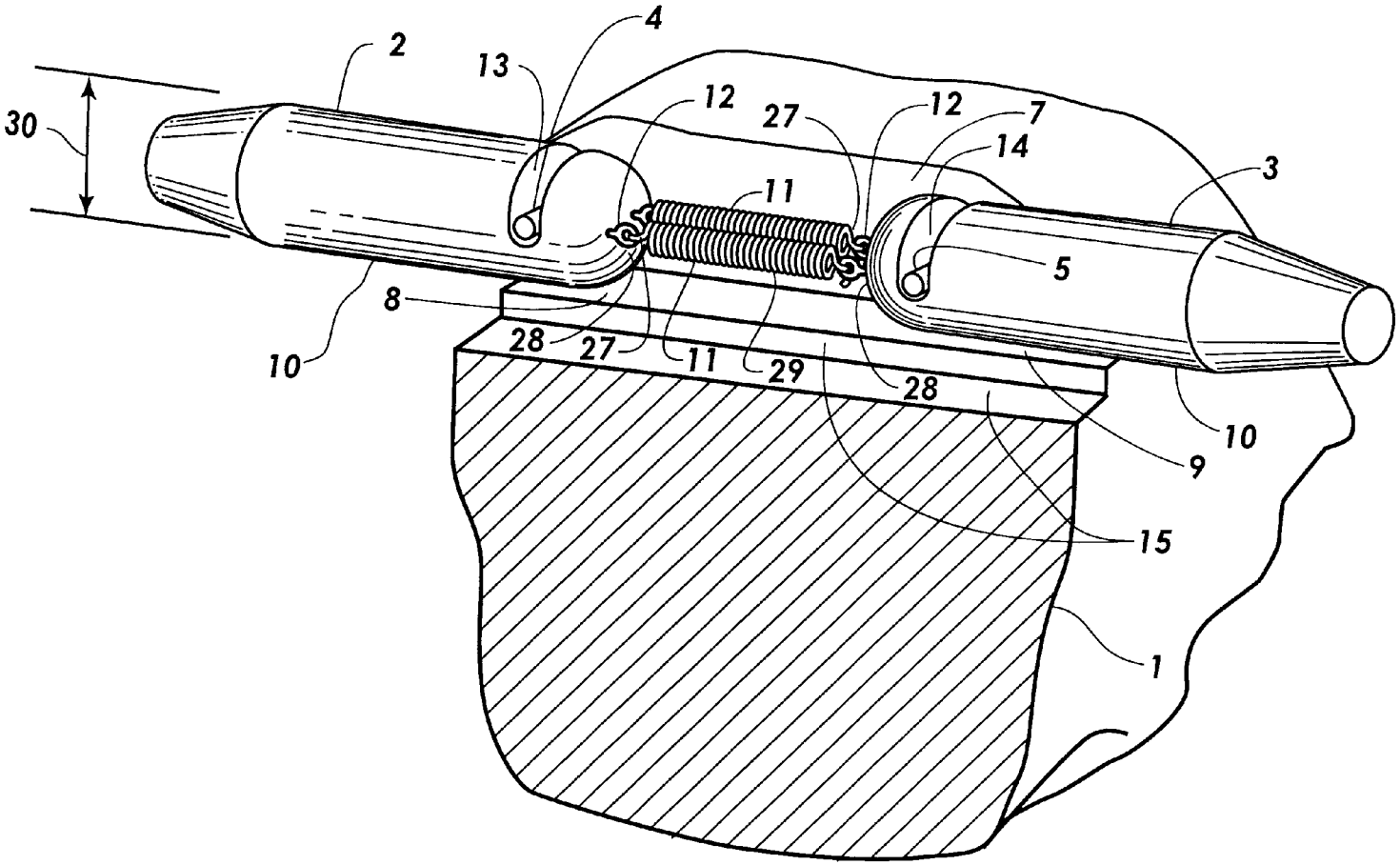
FIG. 8 is a front view perspective cross section of an embodiment of the present invention with two tension springs attached to the inside end of each horn.

Other embodiments of the present invention may utilize more than one tension spring. For these embodiments, the springs are preferably attached side by side to the bottom or inside end of each horn in the same manner as that shown in FIG. 2 or FIG. 6 for one tension spring. FIG. 7 shows an embodiment utilizing two tension springs with the tension springs attached to the bottom of each horn and FIG. 8 shows an embodiment utilizing two tension springs with the tension springs attached to the inside end of each horn.

Other embodiments and other variations and modifications of the embodiments described above will be obvious to a person skilled in the art. Therefore, the foregoing is intended to be merely illustrative of the invention and the invention is limited only by the following claims.

What is claimed is:

1. Apparatus for roping training comprising:

a) simulated steer head having a pair of transverse pivot grooves in the top of the steer head;

b) pair of readily removable and replaceable simulated steer horns, each horn being attached to the simulated steer head in a respective pivot groove, each horn having a horn bolt groove in the top of the inside end of the horn and each horn being pivotally and readily removably attached to the simulated steer head by inserting the horn bolt groove laterally onto a respective pivot bolt in the respective pivot groove; and c) one or more readily detachable tension springs, each tension spring being stretched between the horns and being readily removably attached to the bottom of each horn respectively.

2. Apparatus as recited in claim 1 wherein the horns are readily removable and replaceable with replacement horns of varying lengths and characteristics.

3. Apparatus as recited in claim 2 wherein the pivot grooves and the pivot bolts are angled rearward, thereby providing for rearward rotation of the tips of the horns as they are pivoted from a down position to an up release position.

4. Apparatus as recited in claim 2 wherein the simulated steer head has a spring groove in the bottom of the pivot grooves.

5. Apparatus as recited in claim 3 wherein the simulated steer head has a spring groove in the bottom of the pivot grooves.

6. Apparatus as recited in claim 1 further comprising head pivoting means for pivotally attaching the steer head to a support, for maintaining an anatomically correct head down position when no force is applied to the horns by a roping trainee, for enhancing the release of a lasso rope from around the horns by providing for upward pivoting of the head as the lasso rope is pulled by a roping trainee, and for returning the head to the anatomically correct head down position after the lasso rope is released.

7. Apparatus for roping training comprising:

a) simulated steer head having a pair of transverse pivot grooves in the top of the steer head;

b) pair of readily removable and replaceable simulated steer horns, each horn being attached to the simulated steer head in a respective pivot groove, each horn having a horn bolt groove in the top of the inside end of the horn and each horn being pivotally and readily removably attached to the simulated steer head by inserting the horn bolt groove onto a respective pivot bolt in the respective pivot groove; and c) one or more readily detachable tension springs, each tension spring being stretched between the horns and being readily removably attached to the inside end of each horn respectively.

8. Apparatus as recited in claim 7 wherein the horns are readily removable and replaceable with replacement horns of varying lengths and characteristics.

9. Apparatus as recited in claim 8 wherein the pivot grooves and the pivot bolts are angled rearward, thereby providing for rearward rotation of the tips of the horns as they are pivoted from a down position to an up release position.

10. Apparatus as recited in claim 8 wherein the simulated steer head has a spring groove in the bottom of the pivot grooves.

11. Apparatus as recited in claim 9 wherein the simulated steer head has a spring groove in the bottom of the pivot grooves.

12. Apparatus as recited in claim 7 further comprising head pivoting means for pivotally attaching the steer head to a support, for maintaining an anatomically correct head down position when no force is applied to the horns by a roping trainee, for enhancing the release of a lasso rope from around the horns by providing for upward pivoting of the head as the lasso rope is pulled by a roping trainee, and for returning the head to the anatomically correct head down position after the lasso rope is released.

* * * * *